US011725386B2

(12) United States Patent
McManus

(10) Patent No.: US 11,725,386 B2
(45) **Date of Patent: *Aug. 15, 2023**

(54) SERRATED BEAM

(71) Applicant: Simpson Strong-Tie Company, Inc., Pleasanton, CA (US)

(72) Inventor: Patrick McManus, Timnath, CO (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/948,580

(22) Filed: Sep. 24, 2020

(65) Prior Publication Data

US 2021/0222434 A1 Jul. 22, 2021

Related U.S. Application Data

(63) Continuation-in-part of application No. 15/929,292, filed on Apr. 23, 2020, now Pat. No. 11,028,573.
(Continued)

(51) Int. Cl.

| | |
|---|---|
| ***E04C 3/06*** | (2006.01) |
| ***E04B 5/40*** | (2006.01) |
| *E04C 3/04* | (2006.01) |

(52) U.S. Cl.
CPC ..... *E04C 3/06* (2013.01); *E04B 5/40* (2013.01); *E04B 2103/02* (2013.01); *E04C 2003/0439* (2013.01); *E04C 2003/0452* (2013.01)

(58) Field of Classification Search
CPC ..... E04C 2003/0413; E04C 2003/0434; E04C 2003/0421; E04C 2003/0452; E04C 3/294; E04C 3/06; E04B 5/29; E04B 5/40
See application file for complete search history.

(56) References Cited

U.S. PATENT DOCUMENTS 1,885,883 A 11/1932 Young
2,246,578 A 6/1941 De Salardi
(Continued)

FOREIGN PATENT DOCUMENTS

AU 2009200214 A1 8/2009
CA 2671647 A1 1/2011
(Continued)

OTHER PUBLICATIONS

Jenmar Product Catalog, "Beam", Specifically "Heat Treated Serrated Steel Beams (Waffle)", accessed at https://www.jennmar.com/product-beams on Feb. 14, 2020, 2 pages; actual date of publication unknown.

(Continued)

*Primary Examiner* — Brian E Glessner
*Assistant Examiner* — Daniel J Kenny
(74) *Attorney, Agent, or Firm* — Vierra Magen Marcus LLP

(57) ABSTRACT

A structural member section is provided that may be comprised of horizontal top and bottom flange elements interconnected by one or more vertical web member. The top flange of the member is serrated such that a series of serrations protrude horizontally in at least one direction from a top of the one or more vertical web member or are cut-out from the flange of a rolled shape. In one embodiment, the serrated top flange and at least a portion of the web member are intended to be encased by a horizontal concrete slab or slab-on-deck assembly. The slab material is capable of encasing all exposed surfaces of and curing around each serration to transfer horizontal shear forces between the serrated top flange and the slab material such that the member and slab behave compositely without needing additional reinforcing located within the voids between serrations.

15 Claims, 7 Drawing Sheets

Related U.S. Application Data

(60) Provisional application No. 62/962,008, filed on Jan. 16, 2020.

(56) References Cited

U.S. PATENT DOCUMENTS 2,340,176 A * 1/1944 Cueni ..... E04C 3/294 52/334
2,928,512 A 3/1960 Slater et al.
3,196,763 A 7/1965 Rushton
3,335,596 A * 8/1967 Noda ..... B21H 8/00 72/194
3,538,668 A 11/1970 Anderson
3,626,653 A 12/1971 Amirikian
3,956,864 A * 5/1976 Fung ..... E04B 5/40 52/448
4,115,971 A 9/1978 Varga
4,129,974 A * 12/1978 Ojalvo ..... E04C 3/06 29/897.35
4,133,158 A * 1/1979 Ting ..... B32B 3/28 52/478
4,338,381 A 7/1982 Rogers
4,700,519 A * 10/1987 Person ..... E04B 5/40 52/334
5,509,243 A 4/1996 Bettigole et al.
5,553,437 A 9/1996 Navon
5,664,378 A * 9/1997 Bettigole ..... E01D 19/125 404/70
5,704,181 A 1/1998 Fisher et al.
D454,403 S 3/2002 Naccarato et al.
6,415,581 B1 * 7/2002 Shipman ..... E04B 5/40 428/593
6,442,908 B1 9/2002 Naccarato et al.
6,453,973 B1 9/2002 Russo
6,871,462 B2 * 3/2005 Azizinamini ..... E04B 5/29 52/432
7,197,854 B2 * 4/2007 Bettigole ..... E01D 19/125 52/414
7,325,771 B2 * 2/2008 Stulc ..... B64C 1/1492 244/119
7,556,454 B2 7/2009 Cable et al.
7,721,491 B2 * 5/2010 Appel ..... E04B 1/0023 52/169.7
7,740,202 B2 * 6/2010 Namaizawa ..... B64C 3/18 244/123.1
8,516,762 B1 * 8/2013 Jendusa ..... E04B 5/263 52/407.4
9,896,180 B2 * 2/2018 Raeckers ..... B64C 1/064
10,151,106 B2 12/2018 Niemann
11,028,573 B1 * 6/2021 McManus ..... E04B 5/29
2003/0188499 A1 10/2003 Bronner
2012/0079782 A1 4/2012 Kim
2014/0325937 A1 11/2014 Kim

FOREIGN PATENT DOCUMENTS

CN 201867048 U 6/2011
CN 102425258 A 4/2012
CN 107023114 B 3/2019
DE 3836592 A1 5/1989
DE 4113028 A1 10/1992
DE 29505968 U1 9/1995
DE 202006007405 U1 5/2007
EP 0369914 A1 5/1990
EP 1690999 A2 8/2006
FR 726897 A 6/1932
FR 910506 A 6/1946
FR 2652600 A2 4/1991
JP 2004076379 A 3/2004
KR 100796216 B1 1/2008
LU 88443 A1 7/1995
WO 2007141370 A1 12/2007

OTHER PUBLICATIONS

International Search Report and Written Opinion for PCT/US2021/070047 dated Apr. 9, 2021.

* cited by examiner

SERRATED BEAM

CROSS-REFERENCE TO RELATED APPLICATIONS

This application is a Continuation in Part of U.S. Non-Provisional patent application Ser. No. 15/929,292, filed Apr. 23, 2020, which claims the benefit of U.S. Provisional Patent Application No. 62/962,008, filed Jan. 16, 2020, the entire disclosures of which is hereby incorporated by reference.

FIELD OF THE INVENTION

The present invention relates to a structural beam section, and more particularly to a structural beam section intended to transfer vertical loads through shear and flexural actions along the length of a member to one or more structural supports.

BACKGROUND OF THE INVENTION

Composite beams and joists are widely used in conventional steel construction. Typically, the beam or joist is located entirely below the composite slab-on-deck assembly. The transfer of horizontal shear forces between the concrete slab and the steel beam or joist is most commonly accomplished through the use of shear connectors, often in the form of headed anchor studs, which are welded to the top of the beam or joist prior to slab placement.

Other art, such as that of Brendel (DE 29505968 U1) utilizes a beam encased in the concrete slab. Instead of headed anchor studs, the structure of Brendel uses reinforcing dowels disposed through voids in the top flange of the steel beam section to transfer shear forces between the concrete slab and the steel beam.

SUMMARY OF THE INVENTION

The present invention utilizes a serrated top flange encased in a concrete slab. In one embodiment, the headed serrations encased in the slab may transfer horizontal shear forces between a member and the concrete slab without the use of reinforcing dowels. In another embodiment, reinforcing dowels or rebar may be inserted through one or more voids defined by the serrations. A structural member assembly of the present invention may span substantially horizontally between one or more supports, and the top flange of the cross section is comprised of a serrated geometry. In one embodiment, the serrated geometry comprises portions of one or both sides of the top flange of an I-beam being cut out in an alternating pattern. Many cut-out patterns in the flange, as well as configurations of member shapes and flange orientations are possible and foreseeable.

The top flange of the cross section is intended to be encased by a typically concrete slab such that the serrations in the top flange of the member are encapsulated or encased by the concrete slab. The geometry of the serrations results in voids in the top flange between serrations through which reinforcing dowels could be placed to penetrate portions of the top flange. However, the encased serrations of the present invention may facilitate horizontal shear transfer between the cross section and the surrounding slab medium thereby creating composite action between the member and surrounding slab without the use of reinforcing dowels or other ancillary components. A principal function of one embodiment of this composite beam assembly is to transfer vertical loads applied along the length of the beam to one or more supports along the length of the member through shear and flexural forces in the composite assembly without having to install ancillary reinforcing dowels, headed shear studs, or other mechanisms of shear force transfer to transfer shear load from the slab to the beam.

The member may be comprised of unitary construction or built-up of structural plates, angles, 'T' shaped, 'I' shaped, rectangular or other similar geometric cross sections, though the use of other cross sections are also within the scope of the present invention. The serrations each side of the top flange of the member may be aligned in various configurations, such as alternating portions on the respective sides of the web, or mirror images on either side of the web. Multiple shapes of cut-outs and remaining portions of the flange are provided but may take the form of any shape which facilitates the composite action contemplated herein.

In one embodiment, the member may be self-contained as a beam acting compositely with the surrounding slab. The serrations are comprised of headed geometry whereby the head at the end of each serration has a width measured parallel to the long direction of the member greater than that of the serration shaft, which is disposed between the serration head and the member top flange. While the shape of the head and shaft of the serrations in this embodiment is substantially rectangular, the use of square, circular, elliptical, bulbed, 'L' shaped, 'T' shaped or other geometry for each of the head and shaft, or for head and shaft as a unit, is within the scope of the present invention.

In another embodiment, additional structural elements may be attached to the top or bottom of the member such that the member acts as the top or bottom chord of a joist or truss assembly, or as the top or bottom flange section of a deep built-up girder. The serrations each side of the top flange of the member may be aligned or staggered. While the shape of the serrations may be substantially rectangular, the use of square, circular, elliptical, bulb, 'L' shaped, 'T' shaped, or other geometry are also within the scope of the present invention.

In another embodiment, the member may include horizontal bracing of the top flange during placement of a concrete slab to resist lateral torsional buckling of the member prior to curing of the concrete slab. In one embodiment, a compression strut member may be fastened to decking supported by the bottom flange of the member. The end of the compression strut member may be placed in bearing on the web component of the member and extends vertically near the top flange to provide restraint against horizontal movement of the top flange.

In one embodiment, horizontal bracing of the top flange is accomplished through the use of U-shaped straps wrapped around the shaft portion of the serrations to create interlock between straps. The spacing of the legs of the U-shaped straps may be such that they straddle the shaft portion, but are restrained from being pulled away from the member by the head portion of the serrations. The serrations and the ends of the U-shaped strap may be fastened to the decking supported by the bottom flange of the member. While interlock of the strap with the headed serrations is described in this embodiment, other mechanisms of attaching a strap to the top flange of the member and decking is also within the scope of the present invention.

In another embodiment, the geometry of the serrations may result in voids in the top flange that allow for substantially vertical portions of dowels to be placed within the void space and extended above and below the top flange of the member to further assist with shear transfer between the slab and the member. Such dowels may not be required to facilitate shear transfer between the slab and the member and the serrations are sized such that all design composite action is obtained solely through the interface between the slab and the serrations.

In one embodiment, a substantially vertical web extension is disposed above, and connected to, the serrated top flange of the member. The vertical web extension also includes serrations along the edge opposite of the edge connected to the member. The serrations in, and encasement of, the web extension is consistent with the previous descriptions of the serrated top flange and could have similar shapes and configurations. The vertical web extension could be connected to the top flange, or of unitary construction with the web of the member such that the top flange is divided and connected to either side of the web.

While the member is envisioned to be comprised of steel material and the slab comprised of concrete material, the use of other materials is also within the scope of the present invention. The member in its entirety or individual components of the member may be formed from metal, primarily structural steel, through known fabrication processes such as cutting from plate, casting, built up of welded or bolted shapes, machining, forming from cold bending of plates, extruding, hot rolling, or from other fabrication or manufacturing processes. However, other known materials, such as carbon fiber or other metals, and other manufacturing processes are also within the scope of the present invention.

DESCRIPTION OF THE SEVERAL VIEWS OF THE DRAWINGS

The accompanying drawings form a part of the specification and are to be read in conjunction therewith, in which like reference numerals are employed to indicate like or similar parts in various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit of the scope of the present invention. The present invention is defined by the appended claims and, therefore, the description is not to be taken in a limiting sense and shall not limit the scope of the equivalents to which such claims are entitled.

Figure 1A:
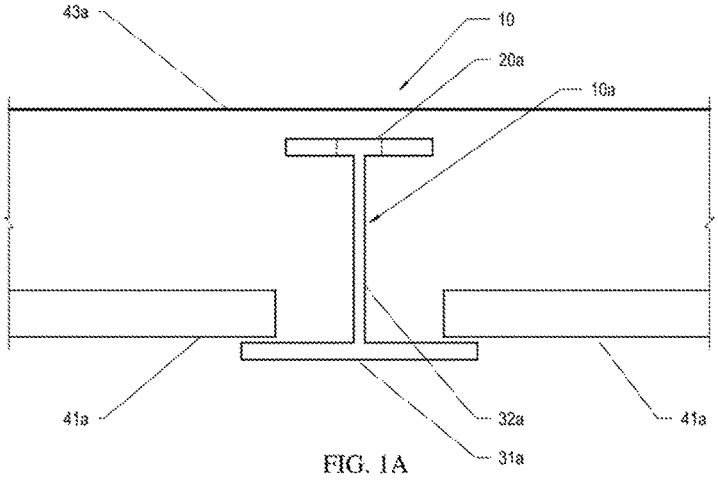
FIG. 1A is a cross sectional view of one embodiment of a member and slab assembly in accordance with the teachings of the present disclosure.
Figure 1B:
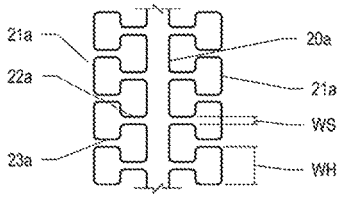
FIG. 1B is a top view of one embodiment of a serrated top flange in accordance with the teachings of the present disclosure and which may be used in the member of FIG. 1A.
Figure 1C:
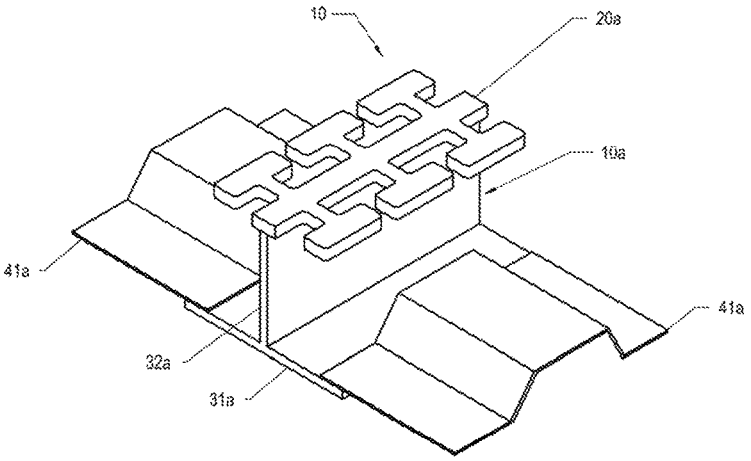
FIG. 1C is an isometric view of one embodiment of a member and decking assembly in accordance with the teachings of the present disclosure and which may be used in member and slab assembly of FIG. 1A.

FIGS. 1A, 1B and 1C show an embodiment of a member and slab assembly 10 in which a serrated top flange 20*a* of a member 10*a* is interconnected to the vertical web 32*a* of the member 10*a*. The vertical web 32*a* of the member 10*a* is interconnected to the bottom flange 31*a* of the member 10*a*. The serrated top flange 20*a* of the member 10*a* and vertical web 32*a* of the member 10*a* are encased by the concrete slab 43*a*. As illustrated in FIG. 1B, the headed serrations 21*a* on one side of serrated top flange 20*a* are substantially aligned with the serrations 21*a* on the opposite side of serrated top flange 20*a*. Each serration 21*a* is comprised of a head 23*a* and a shaft 22*a* whereby the width "WH" of the head 23*a* measured parallel to the long axis of the top flange 20*a* is greater than the width "WS" of the shaft 22*a* measured parallel to the long axis of the top flange 20*a*.

The headed serrations 21*a* may engage the concrete slab 43*a* such that the serrated top flange 20*a* and the concrete slab 43*a* undergo strains of similar magnitude and direction under applied loading along the length of top flange 20*a* thereby creating composite action without the use of ancillary dowels or other components. Serrations 21*a* need not be present the full length of top flange 20*a* and could be strategically located and spaced on the serrated top flange 20*a* for efficient fabrication and load transfer. Decking 41*a* spans between the bottom flange 31*a* of the member to support concrete slab 43*a* during placement and helps transfer superimposed loads imparted to the concrete slab 43*a* to the bottom flange of the member 31*a*.

Generally throughout, concrete slab 43*a* may be another structural medium which can be poured or installed in more of a liquid state, then cured or solidified into a more rigid or solid state. Concrete is a good example, but it could be flowable grout, epoxy mixtures, or another similar structural medium.

Figure 2A:
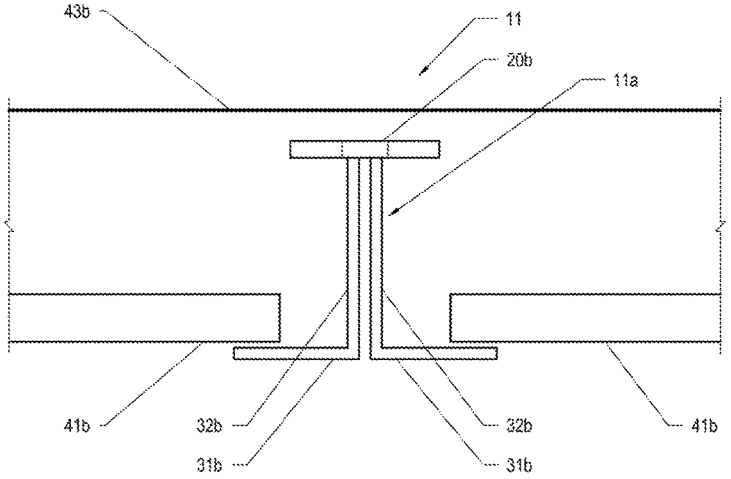
FIG. 2A is a cross sectional view of one embodiment of a member and slab assembly in accordance with the teachings of the present disclosure.
Figure 2B:
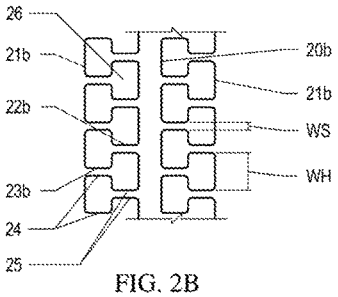
FIG. 2B is a top view of one embodiment of a serrated top flange in accordance with the teachings of the present disclosure and which may be used in the member of FIG. 2A.
Figure 2C:
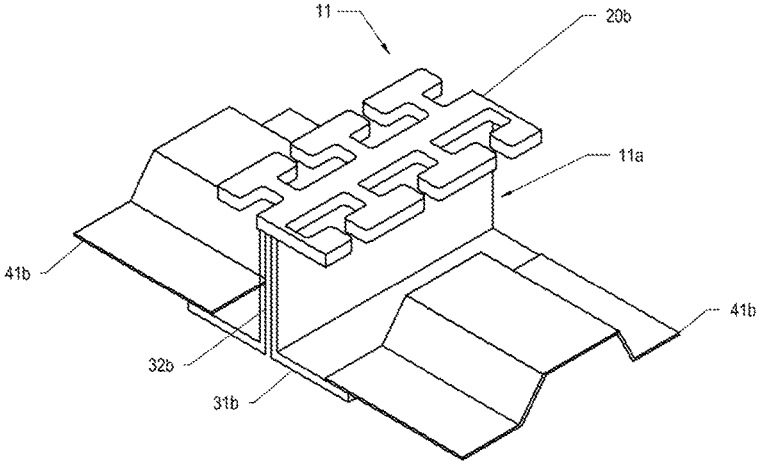
FIG. 2C is an isometric view of one embodiment of a member and decking assembly in accordance with the teachings of the present disclosure and which may be used in member and slab assembly of FIG. 2A.

FIGS. 2A, 2B and 2C show an embodiment of a member and slab assembly 11 in which the serrated top flange 20*b* of the member 11*a* is interconnected to two vertical webs 32*b* of the member. Each vertical web 32*b* of the member 11*a* is interconnected to a bottom flange 31*b* of the member 11*a* such that each web and bottom flange assembly together comprise an 'L' shape. The serrated top flange 20*b* of the member 11*a* and vertical webs 32*b* of the member 11*a* are encased by concrete slab 43*b*.

The headed serrations 21*b* on one side of the serrated top flange 20*b* are staggered along the length of serrated top flange 20*b* in relation to the serrations 21*b* on the opposite side of serrated top flange 20*b*. Each serration 21*b* may be comprised of a shaft 22*b* and a head 23*b* whereby the width of the head 23*b* measured parallel to the long axis of the top flange 20*b* is greater than the width of the shaft 22*b* measured parallel to the long axis of the top flange 20*b*. As further shown in FIG. 2B, in one embodiment, head 23*b* of serration 21*b* may include sides 24 that are substantially linear, and shaft 22*b* of serration 21*b* may also include sides 25 that are substantially linear. As further shown in FIG. 2B, the plurality of serrations 21*b* define a plurality of voids 26 wherein it is shown that the shape of the void defined by the serrations 21*b* is a substantial mirror image of the shape of the serrations 21*b*. The headed serrations 21*b* may engage the concrete slab 43*b* such that the serrated top flange 20*b* and the concrete slab 43*b* undergo strains of similar magnitude and direction under applied loading along the length of top flange 20*b*, thereby creating composite action without the use of ancillary dowels or other components. Serrations 21*b* need not be present the full length of top flange 20*b*. Decking 41*b* spans between the bottom flanges of the member 31*b* to support concrete slab 43*b* during placement and participates in transferring superimposed loads imparted to the concrete slab 43*b* to the bottom flanges 31*b* of the member 11*a*.

Figure 3A:
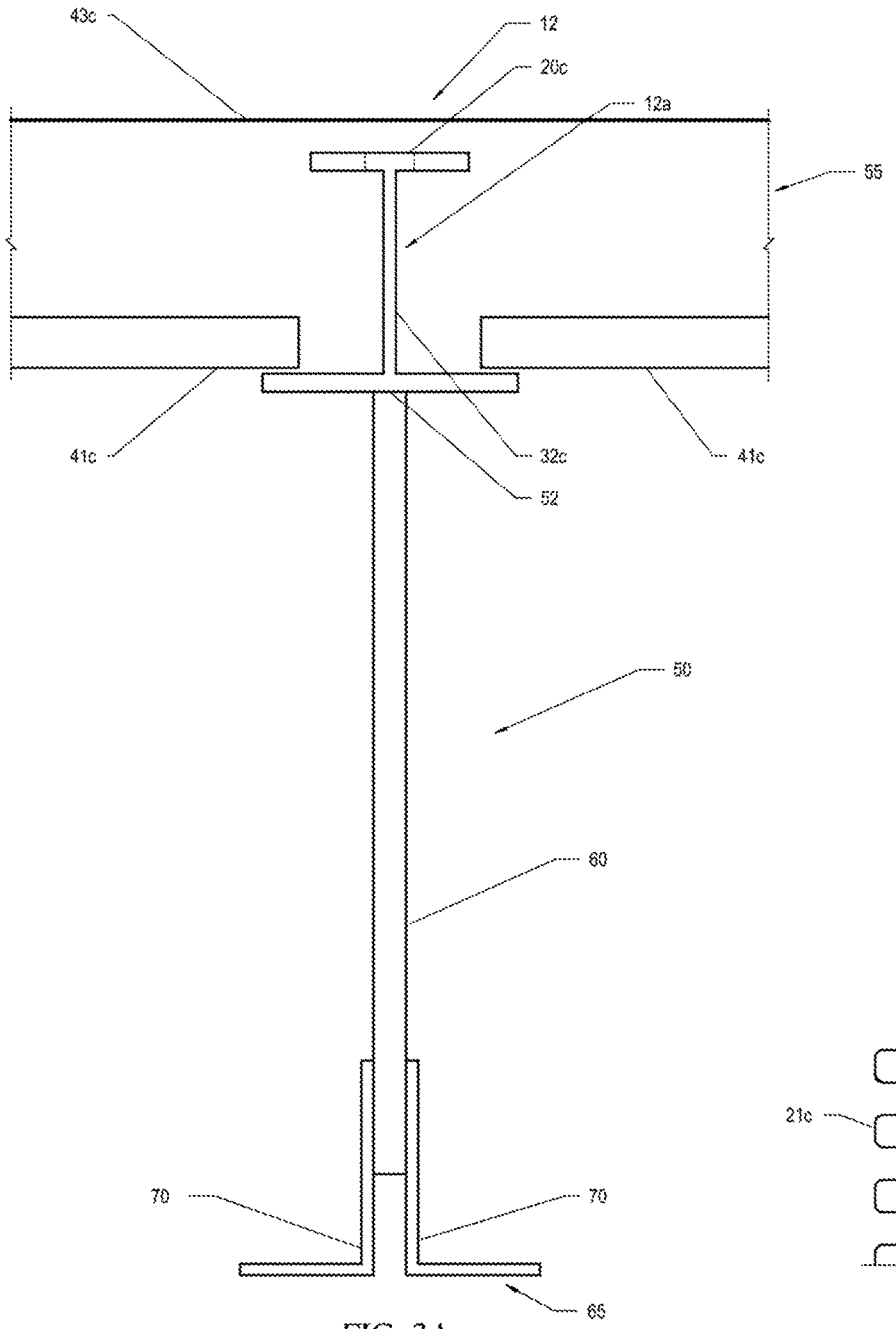
FIG. 3A is a cross sectional view of one embodiment of a member and slab assembly wherein the bottom chord of the truss, or bottom flange of the built-up member is comprised of two 'L' shaped sections in accordance with the teachings of the present disclosure.

FIG. 3A shows an embodiment of a truss, joist or built-up girder assembly 50 in which a top chord 55 of the truss or joist, or top flange 55 of the built-up girder, is comprised of a member and slab assembly 12. The member and slab assembly 12 is interconnected to truss or joist web members 60 in the case of a truss or joist assembly 50, or a web plate 60 in the case of a built-up girder assembly 50.

In one embodiment, a serrated flange 20*c* is connected to a web 32*c*, which may be a WT section or a built-up member. Similarly to other embodiments, decking 41*c* may be supported by a flange member 52 that can either carry compression or tension bending force depending upon where the neutral axis of the composite shape is located. In most embodiments, flange member 52 will typically carry compression force and decking 41*c* laterally braces flange 52 to prevent buckling. In addition, other means of bracing, such as compression struts or straps (as shown in FIGS. 4A, 4B, 4C, 5A, 5B and 5C) may also be utilized in the member and slab assembly 12 to stabilize the top flange. Bracing may be spaced at a regular interval along the length of the member, or may spaced and strategically located to prevent compression buckling of the serrated top flange when the slab is formed.

Figure 3B:
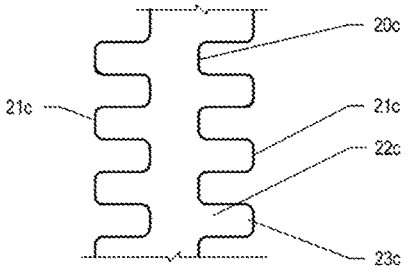
FIG. 3B is a top view of one embodiment of a serrated top flange in accordance with the present disclosure and which may be included in the members of FIG. 3A.

As further illustrated in FIG. 3A, a bottom chord 65 of the truss or joist assembly 50, or bottom flange 65 of a built-up girder assembly 50, is comprised two 'L' shaped sections 70. The 'L' shaped sections 70 are interconnected to the truss or joist web members 60 in the case of a truss or joist assembly 50, or a web plate 60 in the case of a built-up girder assembly 50. In one embodiment, the web plate 60 of a built-up girder may have a series of openings, such as a castellated beam. FIG. 3B shows an embodiment of member and slab assembly 12 in which the serrated top flange 20*c* of a member 12*a* is interconnected to the vertical web of the member 32*c*. The vertical web of the member 32*c* is interconnected to a bottom flange 52 of the member 12*a*. The serrated top flange 20*c* of the member 12*a* and vertical webs 32*c* of the member 12*a* are encased by the concrete slab 43*c*. The serrations 21*c* on one side of the serrated top flange 20*c* are staggered along the length of serrated top flange 20*c*. The substantially rectangular serrations 21*c* may engage the concrete slab 43*c* such that the serrated top flange 20*c* and the concrete slab 43*c* undergo strains of similar magnitude and direction under applied loading along the length of top flange 20*c* thereby creating composite action without the use of ancillary dowels or other components. In this embodiment, the substantially rectangular serrations 21*c* include a shaft 22*c* and a head 23*c* having the same width to define the substantially rectangular shape of serrations 21*c*. Serrations 21*c* need not be present the full length of top flange 20*c*. Decking 41*c* spans between the bottom flanges 31*c* of the member 12*a* to support concrete slab 43*c* during placement. The decking 41 may transfer superimposed loads imparted to the concrete slab 43*c* to the bottom flanges 52 of the member 12*a*.

Figure 4A:
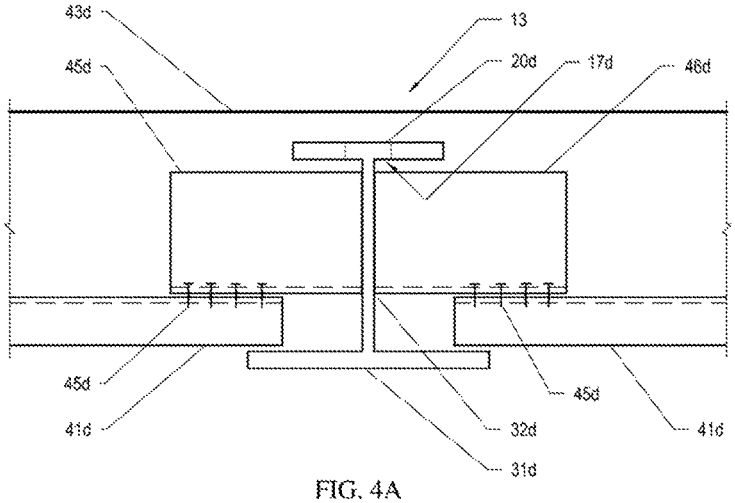
FIG. 4A is a cross section view of one embodiment of member and slab assembly wherein compression struts that extend from near the top flange of the member to decking are placed in bearing against of the web of the member and fastened to decking to brace the top flange of the member against horizontal movement in accordance with the teachings of the present disclosure.
Figure 4B:
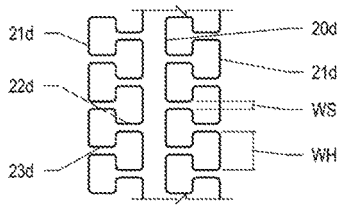
FIG. 4B is top view of one embedment of a serrated top flange in accordance with the present disclosure and which may be included in the members of FIG. 4A.
Figure 4C:
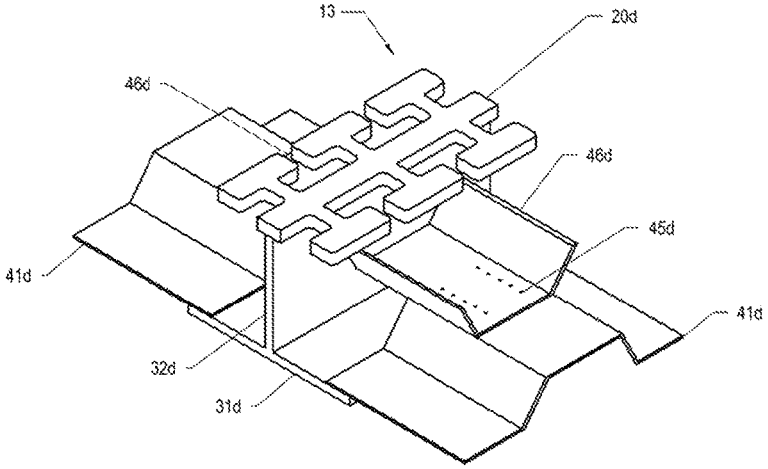
FIG. 4C is an isometric view of one embodiment of a member and decking assembly with compression struts disposed each side of the member web in accordance with the teachings of the present disclosure and which may be used in member and slab assembly of FIG. 4A.

FIGS. 4A, 4B and 4C show an embodiment of a member and slab assembly 13 which is substantially similar to the member slab assembly 10 of FIGS. 1A, 1B and 1C. Compression struts 46*d* are disposed between decking 41*d* and near an underside 17*d* of top flange 20*d* on each side of member web 32*d*. Compression struts 46*d* are further disposed such that one end of each compression strut 46*d* is in contact with member web 32*d* so as to restrain top flange 20*d* from horizontal movement in a direction perpendicular to the long direction of top flange 20*d*, thereby mitigating lateral torsional buckling of the member during placement of the concrete slab 43*d*. Each compression strut 46*d* is attached to decking 41*d* by fasteners 45*d* which may be mechanical fasteners, welds, or the like.

Figure 5A:
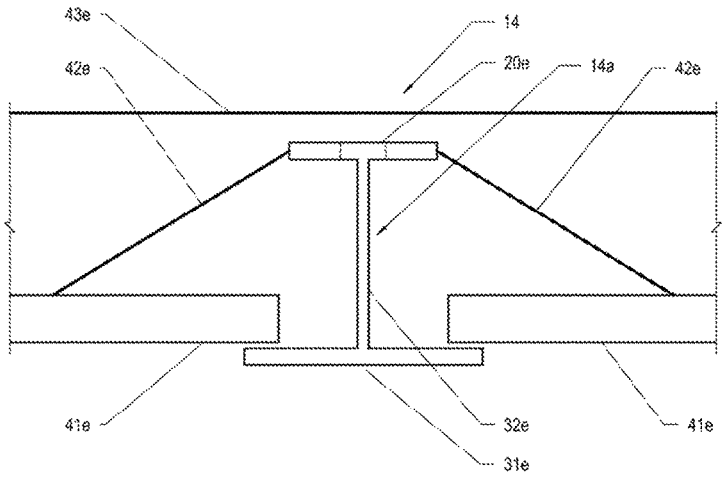
FIG. 5A is a cross section view of one embodiment of member and slab assembly wherein U-shaped straps that interlock with headed serrations at the top flange of the member extend and are fastened to decking to brace the top flange of the member against horizontal movement in accordance with the teachings of the present disclosure.
Figure 5B:
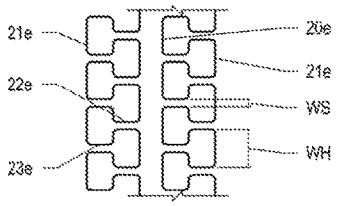
FIG. 5B is top view of one embedment of a serrated top flange in accordance with the present disclosure and which may be included in the members of FIG. 5A.
Figure 5C:
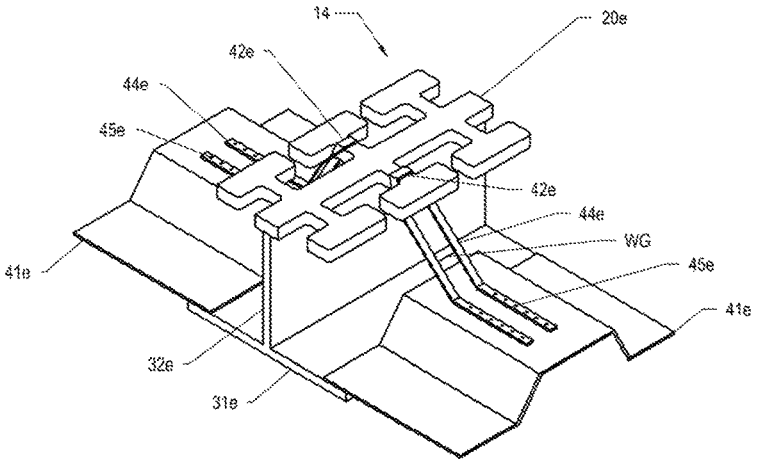
FIG. 5C is an isometric view of one embodiment of a member and decking assembly with U-shaped straps interlocked with headed serrations each side of the member in accordance with the teachings of the present disclosure and which may be used in member and slab assembly of FIG. 5A.

FIGS. 5A, 5B and 5C show an embodiment of a member and slab assembly 14 which is substantially similar to the member slab assembly 10 of FIGS. 1A, 1B and 1C. U-shaped strap 42*e* is disposed around serration shaft 22*e*, and the distance "WG" between strap legs 44*e* is less than the width "WH" of serration head 23*e*, thereby creating interlock between strap 42*e* and serration 21*e*. An end of strap legs 44*e* are attached to decking 41*e* by fasteners 45*e* which may be mechanical fasters, welds or the like. U-shaped straps 42*e* are disposed on each side of top flange 20*e*, restraining top flange 20*d* from horizontal movement in a direction perpendicular to the long direction of top flange 20*e*, and thereby mitigating lateral torsional buckling of member 14*a* during placement of the concrete slab 43*e*.

Figure 6A:
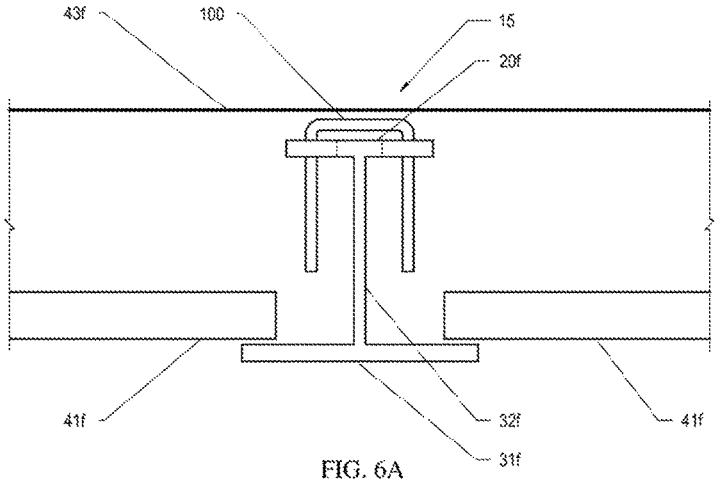
FIG. 6A is a cross sectional view of one embodiment of a member and slab assembly in accordance with the teachings of the present disclosure wherein the vertical portion of U-shaped dowels have been placed through the voids created by the geometry of the headed serrations.
Figure 6B:
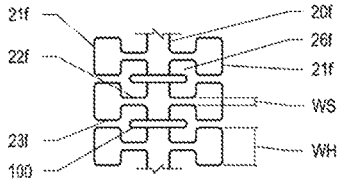
FIG. 6B is a top view of one embodiment of a serrated top flange in accordance with the teachings of the present disclosure and which may be used in the member of FIG. 6A wherein the vertical portion of U-shaped dowels have been placed through the voids created by the geometry of the headed serrations.
Figure 6C:
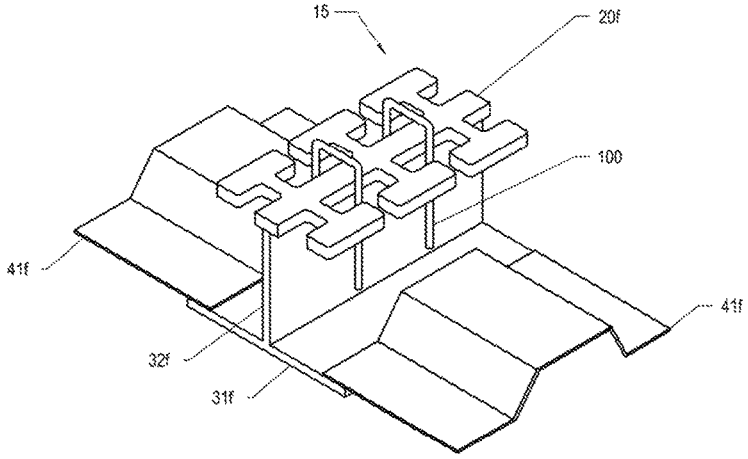
FIG. 6C is an isometric view of one embodiment of a member and decking assembly in accordance with the teachings of the present disclosure and which may be used in member and slab assembly of FIG. 1A wherein the vertical portion of U-shaped dowels have been placed through the voids created by the geometry of the headed serrations.

FIGS. 6A, 6B and 6C show an embodiment of a member and slab assembly 15 which is substantially similar to the member and slab assembly 10 illustrated in FIGS. 1A, 1B and 1C. However, the member and slab assembly 15 includes dowels 100 that are disposed such that vertical portions of dowels 100 extend through voids 26*f* created by the surrounding geometry of top flange 20*f* and headed serrations 21*f*. Dowels 100 assist in the transfer of lateral shear force in the slab to the member. Dowels could be added to the assembly along the entire length in a spaced apart manner or solely in areas of high shear to supplement the shear transfer facilitated solely through the slab and serration 21*f* interface.

Figure 7A:
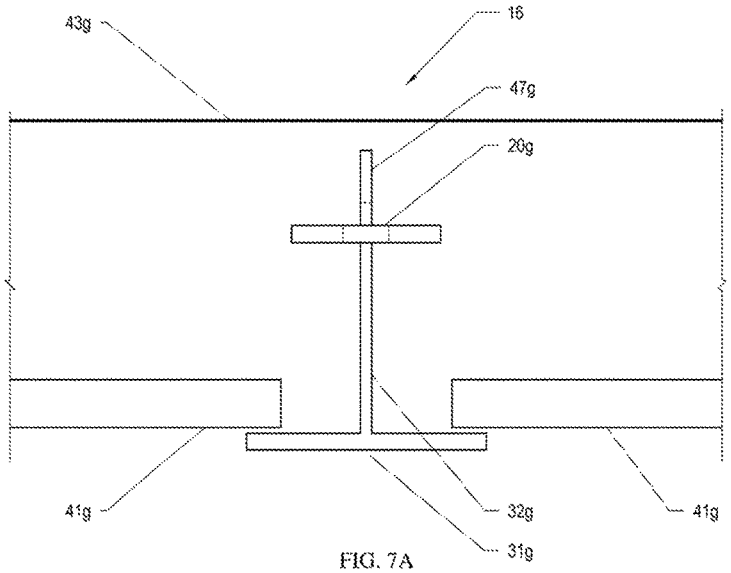
FIG. 7A is a cross sectional view of one embodiment of a member and slab assembly in accordance with the teachings of the present disclosure wherein a serrated vertical web extension is attached to the top of the top flange of the member.
Figure 7B:
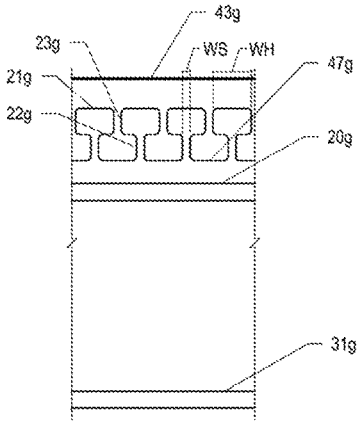
FIG. 7B is a profile view of the member and slab assembly of FIG. 7A wherein a serrated vertical web extension is attached to the top of the top flange of the member in accordance with the teachings of the present disclosure.

FIGS. 7A and 7B show an embodiment of a member and slab assembly 16 which is substantially similar to the member and slab assembly 10 of FIGS. 1A, 1B and 1C. Unlike the member and slab assembly 10, however, a serrated vertical web extension 47*g* is disposed above, and connected to the top of, top flange 20*g*. Serrated vertical web extension 47*g* is encased in slab 43*g*.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

I claim:

1. A structural load bearing assembly comprising:

a structural member;

a serrated horizontal top flange and a serrated vertical top flange connected to the structural member, said serrated horizontal top flange member comprising a first plurality of serrations arranged in a spaced apart manner on the serrated horizontal top flange member and defining a plurality of voids between adjacent serrations of the first plurality of serrations, and said serrated vertical top flange member comprising a second plurality of serrations arranged in a spaced apart manner on the serrated vertical top flange member and defining a plurality of voids between adjacent serrations of the second plurality of serrations, wherein each of the second plurality of serrations comprises a head portion, and a shaft portion, and said plurality of voids each have a shape that is substantially a mirror image of a shape of each of the second plurality of serrations; and wherein a width of the head portion measured in a direction parallel to a long axis of said structural member is greater than a width of the shaft portion measured in the direction parallel to the long axis of said structural member, and wherein each of said shaft portions have a first substantially linear side perpendicular to the long axis and a second substantially linear side, and each of said head portions have a first substantially linear side perpendicular to the long axis and a second substantially linear side;

a structural medium defining a floor slab disposed at a top portion of said structural member, wherein said structural medium encases the first plurality of serrations of the serrated horizontal top flange and the second plurality of serrations of the serrated vertical top flange to provide a horizontal shear transfer between the floor slab through the first and second plurality of serrations to the serrated horizontal and vertical top flanges to sufficiently develop a composite action between the structural member and slab.

2. The structural load bearing assembly claim 1 wherein said first plurality of serrations are present over only a portion of the full length of said structural member.

3. The structural load bearing assembly of claim 1 wherein said structural member is braced against horizontal translation by a bracing member.

4. The structural load bearing assembly of claim 3 wherein the bracing member is selected from a group consisting of metal decking and wood decking.

5. The structural load bearing assembly of claim 3 wherein the bracing member is a U-shaped member wherein the legs of the U-shape are spaced apart at a distance that straddles a shaft of the serration and is restrained by a head of the serration.

6. The structural load bearing assembly of claim 1 further comprising at least one vertical web member coupled to said horizontal serrated top flange member, wherein the structural medium is concrete slab, and said horizontal serrated top flange member and a portion of said at least one vertical web member is encased within said concrete slab.

7. The structural load bearing assembly of claim 6 further comprising a continuous strut or a plurality of intermittent struts operably connected to or placed in contact with at least one side of said vertical web member and said continuous strut or a plurality of intermittent struts operably connected to one of a decking or a forming material that are connected to said one or more horizontal bottom flange members.

8. The structural load bearing assembly of claim 1 wherein said first plurality of serrations comprise a first group of serrations on one side of said serrated horizontal top flange member that are staggered with respect to a second group of serrations on the opposite side of said serrated horizontal top flange member.

9. The structural load bearing assembly of claim 1 wherein said first plurality of serrations comprise a first group of serrations on one side of said serrated horizontal top flange member that are aligned with a second group of serrations on the opposite side of said serrated horizontal top flange member in the direction substantially perpendicular to the long axis.

10. The structural load bearing assembly of claim 1 wherein each of the first and second pluralities of serrations comprises a head and a shaft, and wherein a width of the head measured in a direction parallel to a long axis of said structural member is greater than or equal to a width of the shaft measured in the direction parallel to the long axis of said structural member.

11. The structural load bearing assembly of claim 10 wherein said head and said shaft individually or as a unit are of a geometry including straight, sloped, tapered, stepped, curved, rectangular, circular, elliptical, 'T' shaped, shaped, 'Y' shaped, 'S' shaped, bulb-shaped or inclusive of one or more perforations.

12. The structural load bearing assembly of claim 1 further comprising a structural truss or joist comprising a top chord member and a bottom chord member interconnected by a plurality of vertical web members;

said serrated horizontal top flange member is the top chord member and said serrated horizontal top flange member is interconnected to one or more of the plurality of vertical web members; and each of said plurality of vertical web members are coupled to said bottom chord member.

13. The structural load bearing assembly of claim 12 wherein the structural medium is a concrete slab, and said horizontal serrated top flange member and a portion of said at least one of the plurality of vertical web members is encased within said concrete slab.

14. The structural load bearing assembly of claim 12 wherein each of the first and second pluralities of serrations comprises a head and a shaft, and wherein a width of the head measured in a direction parallel to a long axis of said structural member is greater than or equal to a width of the shaft measured in the direction parallel to the long axis of said structural member.

15. The structural load bearing assembly of claim 1 wherein the serrated vertical top flange extends up above and away from the serrated horizontal top flange.

* * * * *